US010096325B2

(12) United States Patent
Terentiv et al.

(10) Patent No.: US 10,096,325 B2
(45) Date of Patent: Oct. 9, 2018

(54) DECODER AND METHOD FOR A GENERALIZED SPATIAL-AUDIO-OBJECT-CODING PARAMETRIC CONCEPT FOR MULTICHANNEL DOWNMIX/UPMIX CASES BY COMPARING A DOWNMIX CHANNEL MATRIX EIGENVALUES TO A THRESHOLD

(71) Applicant: Fraunhofer-Gesellschaft zur Foerderung der angewandten Forschung e.V., Munich (DE)

(72) Inventors: Leon Terentiv, Erlangen (DE); Oliver Hellmuth, Erlangen (DE); Juergen Herre, Erlangen (DE); Thorsten Kastner, Erlangen (DE)

(73) Assignee: Fraunhofer-Gesellschaft zur Foerderung der angewandten Forschung e.V., Munchen (DE)

( * ) Notice: Subject to any disclaimer, the term of this patent is extended or adjusted under 35 U.S.C. 154(b) by 0 days.

(21) Appl. No.: 14/608,139

(22) Filed: Jan. 28, 2015

(65) Prior Publication Data

US 2015/0142427 A1 May 21, 2015

Related U.S. Application Data

(63) Continuation of application No. PCT/EP2013/066405, filed on Aug. 5, 2013.

(Continued)

(51) Int. Cl.
*G10L 19/00* (2013.01)
*G10L 13/00* (2006.01)

(Continued)

(52) U.S. Cl.
CPC ..... *G10L 19/008* (2013.01); *G10L 13/07* (2013.01); *H04S 1/002* (2013.01)

(58) Field of Classification Search
CPC ..... G10L 19/008

(Continued)

(56) References Cited

U.S. PATENT DOCUMENTS 8,964,994 B2 * 2/2015 Jaillet ..... G10L 19/008 381/20
2008/0049943 A1 2/2008 Faller et al.

(Continued)

FOREIGN PATENT DOCUMENTS

EP 2146344 A1 1/2010
EP 2154911 A1 2/2010

(Continued)

OTHER PUBLICATIONS

Engdegard, et al., "Corrections of the parameter processor for MPEG SAOC", MPEG Meeting, Jan. 2011.

(Continued)

*Primary Examiner* — Farzad Kazeminezhad
(74) *Attorney, Agent, or Firm* — Perkins Coie LLP; Michael A. Glenn

(57) ABSTRACT

A decoder for generating an audio output signal having one or more audio output channels from a downmix signal having one or more downmix channels is provided. The downmix signal encodes one or more audio object signals. The decoder has a threshold determiner for determining a threshold value depending on a signal energy and/or a noise energy of at least one of the of or more audio object signals and/or depending on a signal energy and/or a noise energy of at least one of the one or more downmix channels. Moreover, the decoder has a processing unit for generating the one or more audio output channels from the one or more downmix channels depending on the threshold value, by computing eigenvalues of a downmix channel cross correlation matrix, wherein each eigenvalue except largest eigenvalue is compared to the threshold value, and omitted if they are smaller.

11 Claims, 4 Drawing Sheets

Related U.S. Application Data

(60) Provisional application No. 61/679,404, filed on Aug. 3, 2012.

(51) Int. Cl.

| | |
|---|---|
| ***H04R 5/00*** | (2006.01) |
| ***G10L 19/008*** | (2013.01) |
| ***G10L 13/07*** | (2013.01) |
| *H04S 1/00* | (2006.01) |

(58) Field of Classification Search
USPC ..... 704/258, 500
See application file for complete search history.

(56) References Cited

U.S. PATENT DOCUMENTS

| | | | | |
|---|---|---|---|---|
| 2010/0094631 | A1* | 4/2010 | Engdegard | G10L 19/008 704/258 |
| 2010/0183155 | A1* | 7/2010 | Kim | H04S 3/02 381/17 |
| 2011/0004466 | A1 | 1/2011 | Morii et al. | |
| 2012/0143613 | A1* | 6/2012 | Herre | G10L 19/008 704/500 |

FOREIGN PATENT DOCUMENTS

| | | | |
|---|---|---|---|
| KR | 1020090018804 | A | 2/2009 |
| RU | 2339088 | C1 | 11/2008 |
| WO | 2006008683 | | 1/2006 |
| WO | 2009141775 | | 11/2009 |
| WO | 2010125104 | A1 | 11/2010 |

OTHER PUBLICATIONS

Engdegard, J et al., "Spatial Audio Object Coding (SAOC)—The Upcoming MPEG Standard on Parametric Object Based Audio Coding", AES Convention Paper 7377, AES Convention 124, May 17-20, 2008, pp. 1-15.

Faller, et al., "Binaural Cue Coding—Part II: Schemes and Applications", IEEE Transactions on Speech and Audio Processing, vol. 11, No. 6, Nov. 2003, pp. 520-531.

Faller, C. , "Parametric Joint-Coding of Audio Sources", AES Convention Paper 6752, Presented at the 120th Convention, Paris, France, May 20-23, 2006, 12 pages.

Girin, et al., "Informed audio source separation from compressed linear stereo mixtures", HAL; AES 42nd Int'l Conf. on Semantic Audio, Ilmenau, Germany, Jul. 2011, 11 pages.

Herre, et al., "From SAC to SAOC—Recent Developments in Parametric Coding of Spatial Audio", Illusions in Sound, AES 22nd UK Conference, Apr. 2007, 8 pages.

ISO/IEC, , "Information technology—MPEG audio technologies", ISO/IEC 23003-1:2007, Information technology—MPEG audio technologies—Part 1: MPEG Surround, Feb. 15, 2007, 288 pages.

ISO/IEC, , "Information technology—MPEG audio technologies—Part 2: Spatial Audio Object Coding (SAOC)", ISO/IEC JTC 1/SC 29 N, ISO/IEC FDIS 23003-2:2010(E), Mar. 10, 2010, 133 pages.

Liutkus, A et al., "Informed source separation through spectrogram coding and data embedding", 2011 IEEE Workshop on Applications of Signal Processing to Audio and Acoustics, Oct. 16-19, 2011, 4 pages.

Ozerov, et al., "Informed source separation: source coding meets source separation", IEEE Workshop on Applications of Signal Processing to Audio and Acoustics; Mohonk, NY, Oct. 2011, 5 pages.

Parvaix, M et al., "A Watermarking-Based Method for Informed Source Separation of Audio Signals With a Single Sensor", IEEE Transactions on Audio, Speech and Language Processing, vol. 18, No. 6, Aug. 2010, pp. 1464-1475.

Parvaix, M et al., "Informed source separation of underdetermined instantaneous stereo mixtures using source index embedding", IEEE International Conference on Acoustics, Speech, and Signal Processing (ICASSP 2010) <hal-00486804>, May 26, 2010, pp. 245-248.

Zhang, S. et al., "An informed source separation system for speech signals", 12th Annual Conference of the International Speech Communication Association (Interspeech 2011), Aug. 2011, pp. 573-576.

* cited by examiner

DECODER AND METHOD FOR A GENERALIZED SPATIAL-AUDIO-OBJECT-CODING PARAMETRIC CONCEPT FOR MULTICHANNEL DOWNMIX/UPMIX CASES BY COMPARING A DOWNMIX CHANNEL MATRIX EIGENVALUES TO A THRESHOLD

CROSS-REFERENCE TO RELATED APPLICATIONS

This application is a continuation of copending International Application No. PCT/EP2013/066405, filed Aug. 5, 2013, which claims priority from U.S. Provisional Application No. 61/679,404, filed Aug. 3, 2012, each of which is incorporated herein in its entirety by this reference thereto.

The present invention relates to an apparatus and a method for a generalized spatial-audio-object-coding parametric concept for multichannel downmix/upmix cases.

BACKGROUND OF THE INVENTION

In modern digital audio systems, it is a major trend to allow for audio-object related modifications of the transmitted content on the receiver side. These modifications include gain modifications of selected parts of the audio signal and/or spatial re-positioning of dedicated audio objects in case of multi-channel playback via spatially distributed speakers. This may be achieved by individually delivering different parts of the audio content to the different speakers.

In other words, in the art of audio processing, audio transmission, and audio storage, there is an increasing desire to allow for user interaction on object-oriented audio content playback and also a demand to utilize the extended possibilities of multi-channel playback to individually render audio contents or parts thereof in order to improve the hearing impression. By this, the usage of multi-channel audio content brings along significant improvements for the user. For example, a three-dimensional hearing impression can be obtained, which brings along an improved user satisfaction in entertainment applications. However, multi-channel audio content is also useful in professional environments, for example, in telephone conferencing applications, because the talker intelligibility can be improved by using a multi-channel audio playback. Another possible application is to offer to a listener of a musical piece to individually adjust playback level and/or spatial position of different parts (also termed as "audio objects") or tracks, such as a vocal part or different instruments. The user may perform such an adjustment for reasons of personal taste, for easier transcribing one or more part(s) from the musical piece, educational purposes, karaoke, rehearsal, etc.

The straightforward discrete transmission of all digital multi-channel or multi-object audio content, e.g., in the form of pulse code modulation (PCM) data or even compressed audio formats, demands very high bitrates. However, it is also desirable to transmit and store audio data in a bitrate efficient way. Therefore, one is willing to accept a reasonable tradeoff between audio quality and bitrate requirements in order to avoid an excessive resource load caused by multi-channel/multi-object applications.

Recently, in the field of audio coding, parametric techniques for the bitrate-efficient transmission/storage of multi-channel/multi-object audio signals have been introduced by, e.g., the Moving Picture Experts Group (MPEG) and others. One example is MPEG Surround (MPS) as a channel oriented approach [MPS, BCC], or MPEG Spatial Audio Object Coding (SAOC) as an object oriented approach [JSC, SAOC, SAOC1, SAOC2]. Another object-oriented approach is termed as "informed source separation" [ISS1, ISS2, ISS3, ISS4, ISS5, ISS6]. These techniques aim at reconstructing a desired output audio scene or a desired audio source object on the basis of a downmix of channels/objects and additional side information describing the transmitted/stored audio scene and/or the audio source objects in the audio scene.

The estimation and the application of channel/object related side information in such systems is done in a time-frequency selective manner. Therefore, such systems employ time-frequency transforms such as the Discrete Fourier Transform (DFT), the Short Time Fourier Transform (STFT) or filter banks like Quadrature Mirror Filter (QMF) banks, etc. The basic principle of such systems is depicted in FIG. 2, using the example of MPEG SAOC.

In case of the STFT, the temporal dimension is represented by the time-block number and the spectral dimension is captured by the spectral coefficient ("bin") number. In case of QMF, the temporal dimension is represented by the time-slot number and the spectral dimension is captured by the sub-band number. If the spectral resolution of the QMF is improved by subsequent application of a second filter stage, the entire filter bank is termed hybrid QMF and the fine resolution sub-bands are termed hybrid sub-bands.

As already mentioned above, in SAOC the general processing is carried out in a time-frequency selective way and can be described as follows within each frequency band, as depicted in FIG. 2:

- N input audio object signals $s_1 \ldots s_N$ are mixed down to P channels $x_1 \ldots x_P$ as part of the encoder processing using a downmix matrix consisting of the elements $d_{1,1} \ldots d_{N,P}$. In addition, the encoder extracts side information describing the characteristics of the input audio objects (side-information-estimator (SIE) module). For MPEG SAOC, the relations of the object powers w.r.t. each other are the most basic form of such a side information.
- Downmix signal(s) and side information are transmitted/stored. To this end, the downmix audio signal(s) may be compressed, e.g., using well-known perceptual audio coders such MPEG-1/2 Layer II or III (aka .mp3), MPEG-2/4 Advanced Audio Coding (AAC) etc.
- On the receiving end, the decoder conceptually tries to restore the original object signals ("object separation") from the (decoded) downmix signals using the transmitted side information. These approximated object signals $\hat{s}_1 \ldots \hat{s}_N$ are then mixed into a target scene represented by M audio output channels $\hat{y}_1 \ldots \hat{y}_M$ using a rendering matrix described by the coefficients $r_{1,1} \ldots r_{N,M}$ in FIG. 2. The desired target scene may be, in the extreme case, the rendering of only one source signal out of the mixture (source separation scenario), but also any other arbitrary acoustic scene consisting of the objects transmitted. For example, the output can be a single-channel, a 2-channel stereo or 5.1 multi-channel target scene.

Increasing bandwidth/storage available and ongoing improvements in the field of audio coding allows the user to select from a steadily increasing choice of multi-channel audio productions. Multi-channel 5.1 audio formats are already standard in DVD and Blue-Ray productions. New audio formats like MPEG-H 3D Audio with even more audio transport channels appear at the horizon, which will provide the end-users a highly immersive audio experience.

Parametric audio object coding schemes are currently restricted to a maximum of two downmix channels. They can only be applied to some extend on multi-channel mixtures, for example on only two selected downmix channels. The flexibility these coding schemes offer to the user to adjust the audio scene to his/her own preferences is thus severely limited, e.g., with respect to changing audio level of the sports commentator and the atmosphere in sports broadcast.

Moreover, current audio object coding schemes offer only a limited variability in the mixing process at the encoder side. The mixing process is limited to time-variant mixing of the audio objects; and frequency-variant mixing is not possible.

It would therefore be highly appreciated if improved concepts for audio object coding would be provided.

SUMMARY

According to an embodiment, a decoder for generating an audio output signal having one or more audio output channels from a downmix signal having one or more downmix channels, wherein the downmix signal encodes two or more audio object signals may have: a threshold determiner for determining a threshold value depending on a signal energy or a noise energy of at least one of the two or more audio object signals or depending on a signal energy or a noise energy of at least one of the one or more downmix channels, and a processing unit for generating the one or more audio output channels from the one or more downmix channels depending on the threshold value.

According to another embodiment, a method for generating an audio output signal having one or more audio output channels from a downmix signal having one or more downmix channels, wherein the downmix signal encodes two or more audio object signals may have the steps of: determining a threshold value depending on a signal energy or a noise energy of at least one of the two or more audio object signals or depending on a signal energy or a noise energy of at least one of the one or more downmix channels, and generating the one or more audio output channels from the one or more downmix channels depending on the threshold value.

Another embodiment may have a computer program for implementing the method of claim 13 when being executed on a computer or signal processor.

A decoder for generating an audio output signal comprising one or more audio output channels from a downmix signal comprising one or more downmix channels is provided. The downmix signal encodes one or more audio object signals. The decoder comprises a threshold determiner for determining a threshold value depending on a signal energy and/or a noise energy of at least one of the of or more audio object signals and/or depending on a signal energy and/or a noise energy of at least one of the one or more downmix channels. Moreover, the decoder comprises a processing unit for generating the one or more audio output channels from the one or more downmix channels depending on the threshold value.

According to an embodiment, the downmix signal may comprise two or more downmix channels, and the threshold determiner may be configured to determine the threshold value depending on a noise energy of each of the two or more downmix channels.

In an embodiment, the threshold determiner may be configured to determine the threshold value depending on the sum of all noise energy in the two or more downmix channels.

According to an embodiment, the downmix signal may encode two or more audio object signals, and the threshold determiner may be configured to determine the threshold value depending on a signal energy of the audio object signal of the two or more audio object signals which has the greatest signal energy of the two or more audio object signals.

In an embodiment, the downmix signal may comprise two or more downmix channels, and the threshold determiner may be configured to determine the threshold value depending on the sum of all noise energy in the two or more downmix channels.

According to an embodiment, the downmix signal may encode the one or more audio object signals for each time-frequency tile of a plurality of time-frequency tiles. The threshold determiner may be configured to determine a threshold value for each time-frequency tile of the plurality of time-frequency tiles depending on the signal energy or the noise energy of at least one of the of or more audio object signals or depending on the signal energy or the noise energy of at least one of the one or more downmix channels, wherein a first threshold value of a first time-frequency tile of the plurality of time-frequency tiles may differ from a second time-frequency time of the plurality of time-frequency tiles. The processing unit may be configured to generate for each time-frequency tile of the plurality of time-frequency tiles a channel value of each of the one or more audio output channels from the one or more downmix channels depending on the threshold value if said time-frequency tile.

In an embodiment, the decoder may be configured to determine the threshold value T in decibel according to the formula $$T\,[\mathrm{dB}]=E_{noise}\,[\mathrm{dB}]-E_{ref}\,[\mathrm{dB}]-Z \text{ or according to the formula}$$

$$T\,[\mathrm{dB}]=E_{noise}\,[\mathrm{dB}]-E_{ref}\,[\mathrm{dB}],$$

wherein T [dB] indicates the threshold value in decibel, wherein $E_{noise}$ [dB] indicates the sum of all noise energy in the two or more downmix channels in decibel, wherein $E_{ref}$ [dB] indicates the signal energy of one of the audio object signals in decibel, and wherein Z indicates an additional parameter being a number. In an alternative embodiment, $E_{noise}$ [dB] indicates the sum of all noise energy in the two or more downmix channels in decibel divided by the number of the downmix channels.

According to an embodiment, the decoder may be configured to determine the threshold value T according to the formula $$T=\frac{E_{noise}}{E_{ref}\cdot Z} \text{ or according to the formula}$$

$$T=\frac{E_{noise}}{E_{ref}},$$

wherein T indicates the threshold value, wherein $E_{noise}$ indicates the sum of all noise energy in the two or more downmix channels, wherein $E_{ref}$ indicates the signal energy of one of the audio object signals, and wherein Z indicates an additional parameter being a number. In an alternative embodiment, $E_{noise}$ [dB] indicates the sum of all noise energy in the two or more downmix channels divided by the number of the downmix channels.

According to an embodiment, the processing unit may be configured to generate the one or more audio output channels from the one or more downmix channels depending on an object covariance matrix (E) of the one or more audio object signals, depending on a downmix matrix (D) for downmixing the two or more audio object signals to obtain the two or more downmix channels, and depending on the threshold value.

In an embodiment, the processing unit is configured to generate the one or more audio output channels from the one or more downmix channels by applying the threshold value in a function to inverse a downmix channel cross correlation matrix Q, wherein Q is defined as Q=DED*, wherein D is the downmix matrix for downmixing the two or more audio object signals to obtain the two or more downmix channels, and wherein E is the object covariance matrix of the one or more audio object signals.

For example, the processing unit may be configured to generate the one or more audio output channels from the one or more downmix channels by computing the eigenvalues of the downmix channel cross correlation matrix Q or by calculating the singular values of the downmix channel cross correlation matrix Q.

E.g., the processing unit may be configured to generate the one or more audio output channels from the one or more downmix channels by multiplying the largest eigenvalue of the eigenvalues of the downmix channel cross correlation matrix Q with the threshold value to obtain a relative threshold.

For example, the processing unit may be configured to generate the one or more audio output channels from the one or more downmix channels by generating a modified matrix. The processing unit may be configured to generate the modified matrix depending on only those eigenvectors of the downmix channel cross correlation matrix Q, which have an eigenvalue of the eigenvalues of the downmix channel cross correlation matrix Q, which is greater than or equal to the modified threshold. Moreover, the processing unit may be configured to conduct a matrix inversion of the modified matrix to obtain an inverted matrix. Furthermore, the processing unit may be configured to apply the inverted matrix on one or more of the downmix channels to generate the one or more audio output channels.

Moreover, a method for generating an audio output signal comprising one or more audio output channels from a downmix signal comprising one or more downmix channels is provided. The downmix signal encodes one or more audio object signals. The decoder comprises:

Determining a threshold value depending on a signal energy or a noise energy of at least one of the of or more audio object signals or depending on a signal energy or a noise energy of at least one of the one or more downmix channels. And:

Generating the one or more audio output channels from the one or more downmix channels depending on the threshold value.

Moreover, a computer program for implementing the above-described method when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Before describing embodiments of the present invention, more background on state-of-the-art-SAOC systems is provided.

Figure 2:
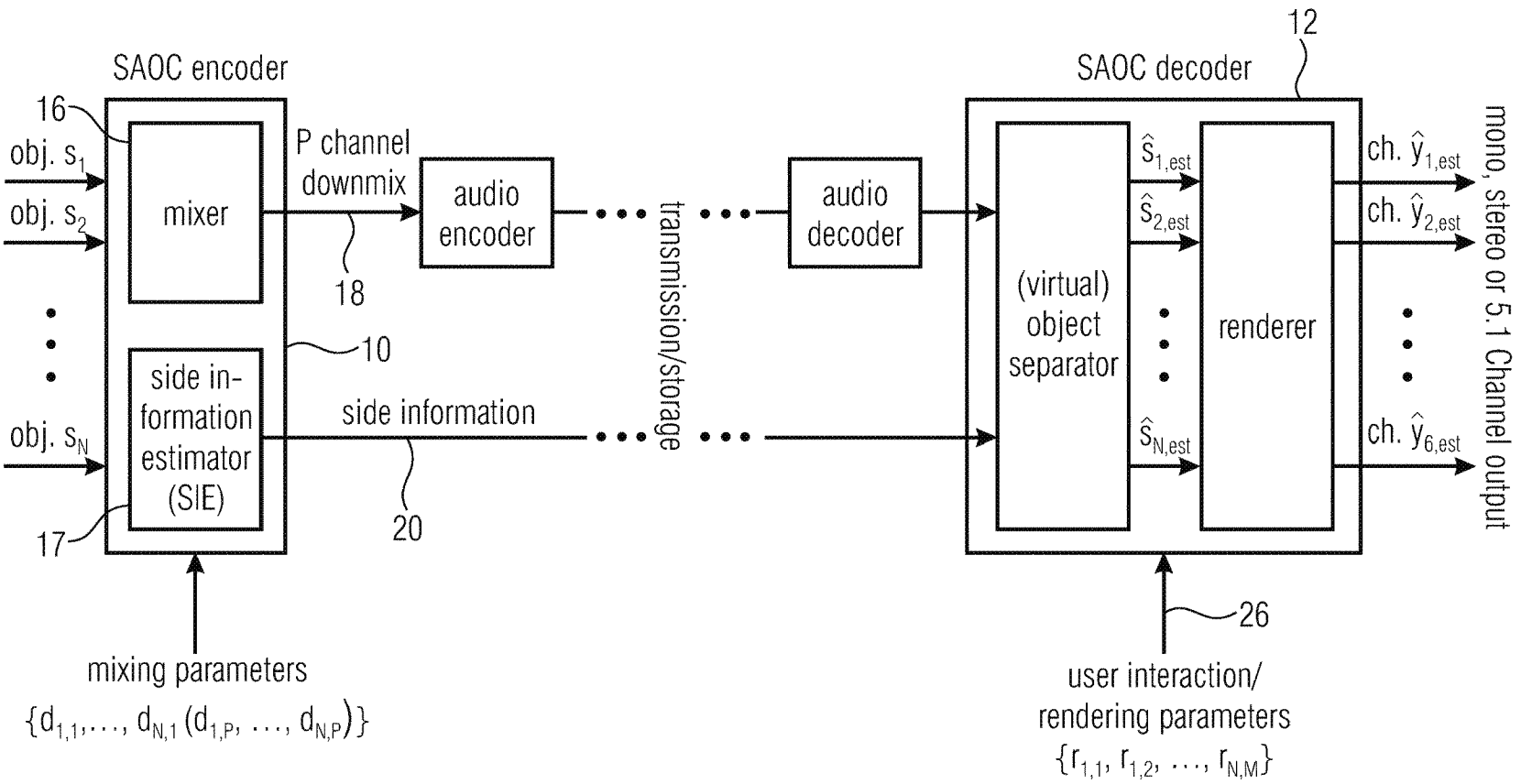
FIG. 2 is a SAOC system overview depicting the principle of such systems using the example of MPEG SAOC.

FIG. 2 shows a general arrangement of an SAOC encoder 10 and an SAOC decoder 12. The SAOC encoder 10 receives as an input N objects, i.e., audio signals $s_1$ to $s_N$. In particular, the encoder 10 comprises a downmixer 16 which receives the audio signals $s_1$ to $s_N$ and downmixes same to a downmix signal 18. Alternatively, the downmix may be provided externally ("artistic downmix") and the system estimates additional side information to make the provided downmix match the calculated downmix. In FIG. 2, the downmix signal is shown to be a P-channel signal. Thus, any mono (P=1), stereo (P=2) or multi-channel (P>2) downmix signal configuration is conceivable.

In the case of a stereo downmix, the channels of the downmix signal 18 are denoted L0 and R0, in case of a mono downmix same is simply denoted L0. In order to enable the SAOC decoder 12 to recover the individual objects $s_1$ to $s_N$, side-information estimator 17 provides the SAOC decoder 12 with side information including SAOC-parameters. For example, in case of a stereo downmix, the SAOC parameters comprise object level differences (OLD), inter-object correlations (IOC) (inter-object cross correlation parameters), downmix gain values (DMG) and downmix channel level differences (DCLD).

The side information 20, including the SAOC-parameters, along with the downmix signal 18, forms the SAOC output data stream received by the SAOC decoder 12.

The SAOC decoder 12 comprises an up-mixer which receives the downmix signal 18 as well as the side information 20 in order to recover and render the audio signals $\hat{s}_1$ and $\hat{s}_N$ onto any user-selected set of channels $\hat{y}_1$ to $\hat{s}_M$, with the rendering being prescribed by rendering information 26 input into SAOC decoder 12.

The audio signals $s_1$ to $s_N$ may be input into the encoder 10 in any coding domain, such as, in time or spectral domain. In case the audio signals $s_1$ to $s_N$ are fed into the encoder 10 in the time domain, such as PCM coded, encoder 10 may use a filter bank, such as a hybrid QMF bank, in order to transfer the signals into a spectral domain, in which the audio signals are represented in several sub-bands associated with different spectral portions, at a specific filter bank resolution. If the audio signals $s_1$ to $s_N$ are already in the representation expected by encoder 10, same does not have to perform the spectral decomposition.

More flexibility in the mixing process allows an optimal exploitation of signal object characteristics. A downmix can be produced which is optimized for the parametric separation at the decoder side regarding perceived quality.

Figure 3:
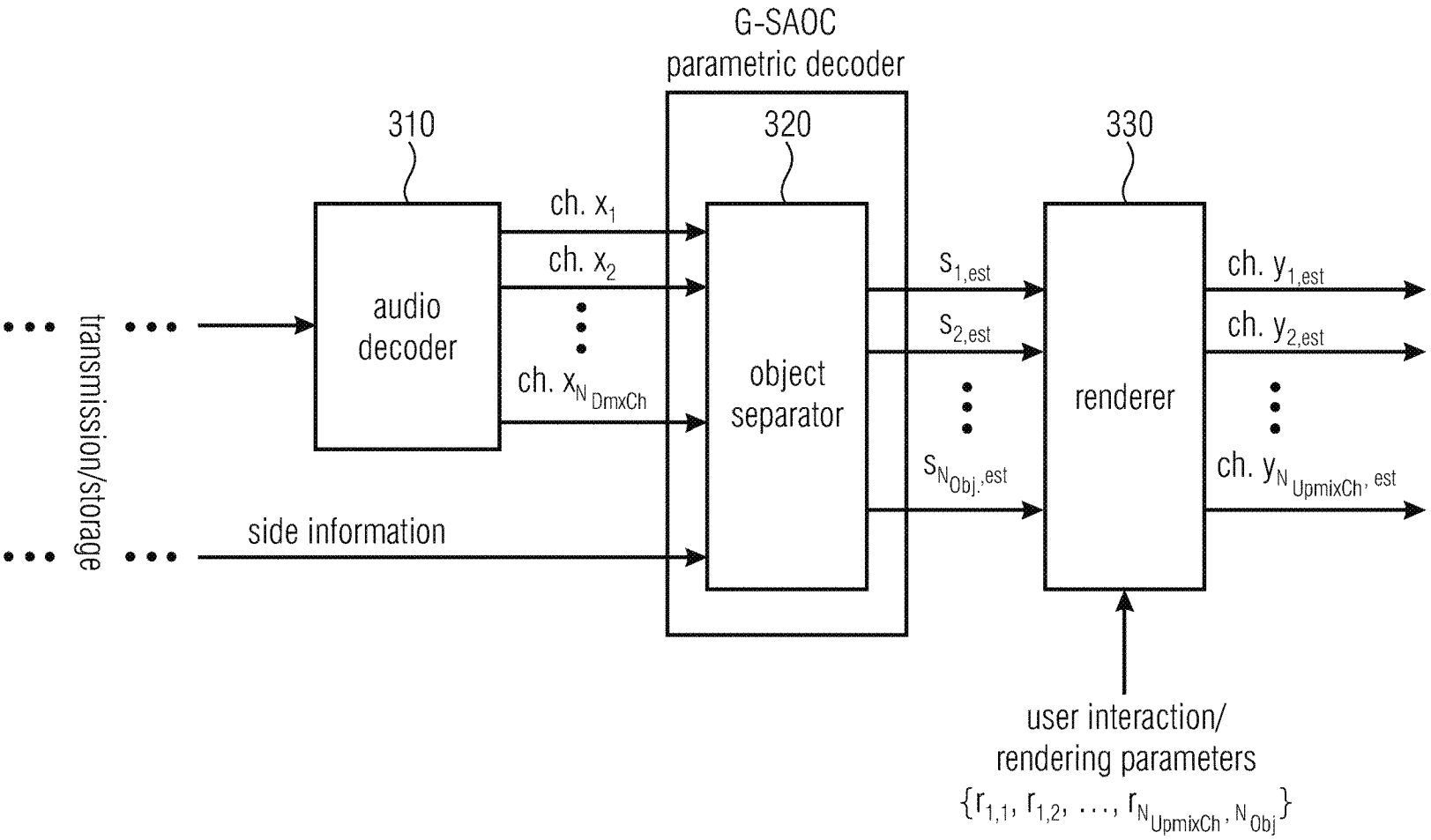
FIG. 3 illustrates an overview of the G-SAOC parametric upmix concept.

The embodiments extends the parametric part of the SAOC scheme to an arbitrary number of downmix/upmix channels. The following figure provides overview of the Generalized Spatial Audio Object Coding (G-SAOC) parametric upmix concept:

FIG. 3 illustrates an overview of the G-SAOC parametric upmix concept A fully flexible post-mixing (rendering) of the parametrically reconstructed audio objects can be realized.

Inter alia, FIG. 3 illustrates an audio decoder 310, an object separator 320 and a renderer 330.

Let us consider the following common notation:

| | | |
|---|---|---|
| x | input audio object signal | (of size $N_{obj}$) |
| y | downmix audio signal | (of size $N_{dmx}$) |
| z | rendered output scene signal | (of size $N_{upmix}$) |
| D | downmix matrix | (of size $N_{obj} \times N_{dmx}$) |
| R | rendering matrix | (of size $N_{obj} \times N_{upmix}$) |
| G | parametric upmix matrix | (of size $N_{dmx} \times N_{upmix}$) |
| E | object covariance matrix | (of size $N_{obj} \times N_{obj}$) |

All introduced matrices are (in general) time and frequency variant.

In the following, the constitutive relationship for parametric upmixing is provided.

Figure 4:
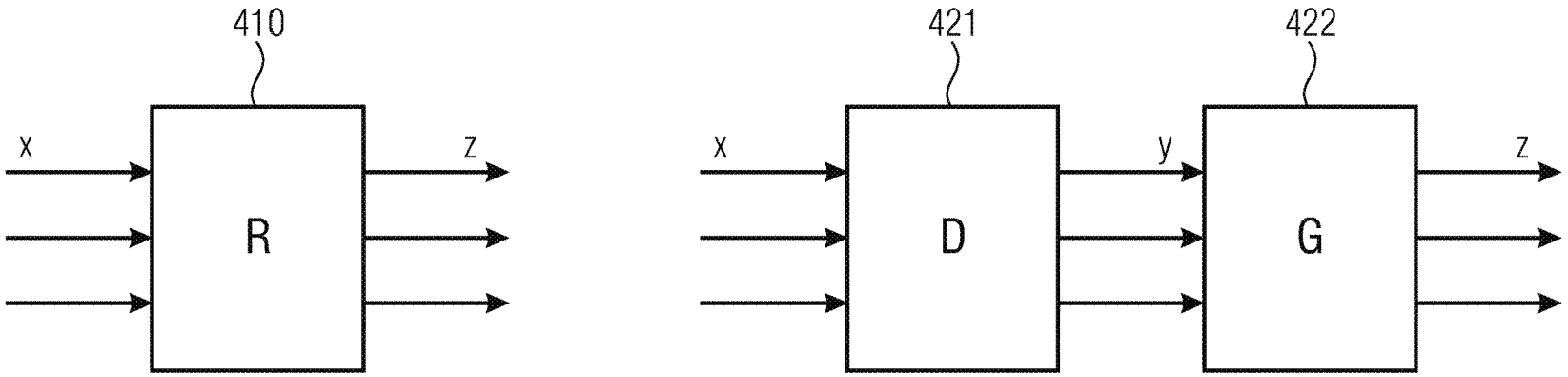
FIG. 4 illustrates a general downmix/upmix concept.

At first, general downmix/upmix concepts are provided with reference to FIG. 4. In particular, FIG. 4 illustrates a general downmix/upmix concept, wherein FIG. 4 illustrates modeled (left) and parametric upmix (right) systems.

More particularly, FIG. 4 illustrates a rendering unit 410, a downmix unit 421 and a parametrix upmix unit 422.

The ideal (modeled) rendered output scene signal z is defined as, see Fig (left):

$$Rx=z. \tag{1}$$

The downmix audio signal y is determined as, see FIG. 4 (right):

$$Dx=y. \tag{2}$$

The constitutive relationship (applied to the downmix audio signal) for the parametric output scene signal reconstruction can be represented as, see FIG. 4 (right):

$$Gy=z. \tag{3}$$

The parametric upmix matrix can be defined from (1) and (2) as the following function of the downmix and rendering matrices G=G(D,R):

$$G=\mathrm{RED}^*(DED^*)^{-1}. \tag{4}$$

In the following, improving the stability of the parametric source estimation according to embodiments is considered.

The parametric separation scheme within MPEG SAOC is based on a Least Mean Square (LMS) estimation of the sources in the mixture. The LMS estimation involves the inversion of the parametrically described downmix-channel covariance matrix Q=DED*. Algorithms for matrix inversion are in general sensitive to ill-conditioned matrices. The inversion of such a matrix can cause unnatural sounds, called artifacts, in the rendered output scene. A heuristically determined fixed threshold T in MPEG SAOC currently avoids this. Although artifacts are avoided by this method, a sufficient possible separation performance at the decoder side can thereby not be achieved.

Figure 1:
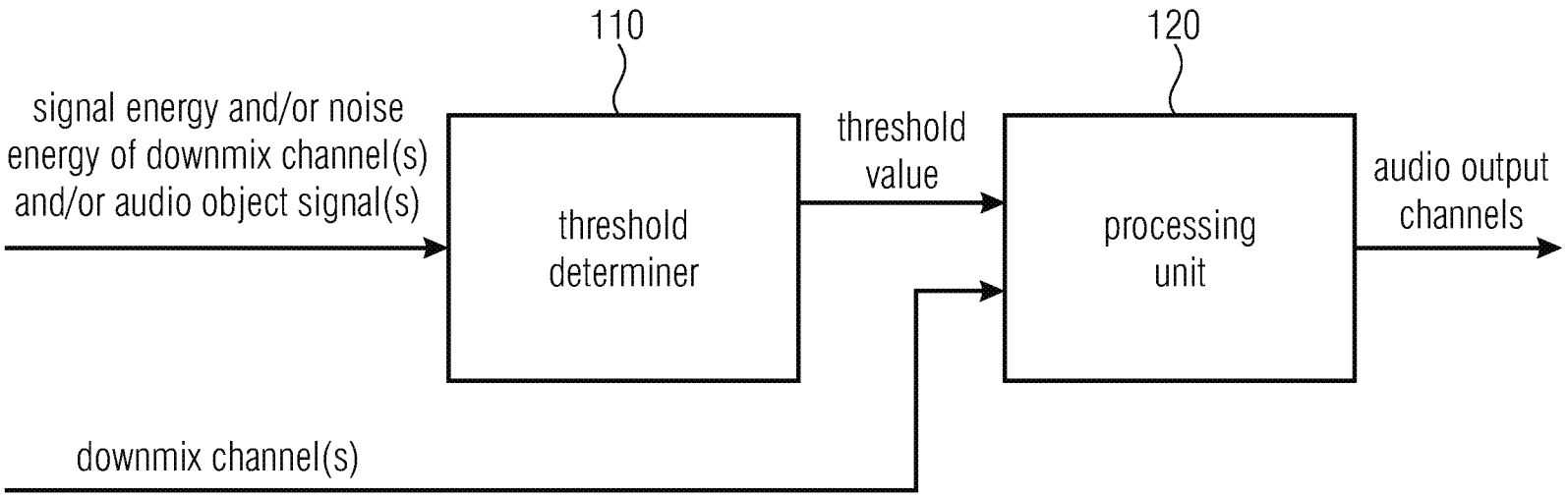
FIG. 1 illustrates a decoder for generating an audio output signal comprising one or more audio output channels according to an embodiment.

FIG. 1 illustrates a decoder for generating an audio output signal comprising one or more audio output channels from a downmix signal comprising one or more downmix channels according to an embodiment. The downmix signal encodes one or more audio object signals.

The decoder comprises a threshold determiner 110 for determining a threshold value depending on a signal energy and/or a noise energy of at least one of the of or more audio object signals and/or depending on a signal energy and/or a noise energy of at least one of the one or more downmix channels.

Moreover, the decoder comprises a processing unit 120 for generating the one or more audio output channels from the one or more downmix channels depending on the threshold value.

In contrast to the state of the art, the threshold value determined by the threshold determiner 110 depends on a signal energy or a noise energy of the one or more downmix channels or of the encoded one or more audio object signals. In embodiments, as the signal and noise energies of the one or more downmix channels and/or of the one or more audio object signal values varies, so varies the threshold value, e.g., from time instance to time instance, or from time-frequency tile to time-frequency tile.

Embodiments provide an adaptive threshold method for matrix inversion to achieve an improved parametric separation of the audio objects at the decoder side. The separation performance is on the average better but never less the currently utilized fixed threshold scheme used in MPEG SAOC in the algorithm for inverting the Q matrix.

The threshold T is dynamically adapted to the precision of the data for each processed time-frequency tile. Separation performance is thus improved and artifacts in the rendered output scene caused by inversion of ill-conditioned matrices are avoided.

According to an embodiment, the downmix signal may comprise two or more downmix channels, and the threshold determiner 110 may be configured to determine the threshold value depending on a noise energy of each of the two or more downmix channels.

In an embodiment, the threshold determiner 110 may be configured to determine the threshold value depending on the sum of all noise energy in the two or more downmix channels.

According to an embodiment, the downmix signal may encode two or more audio object signals, and the threshold determiner 110 may be configured to determine the threshold value depending on a signal energy of the audio object signal of the two or more audio object signals which has the greatest signal energy of the two or more audio object signals.

In an embodiment, the downmix signal may comprise two or more downmix channels, and the threshold determiner 110 may be configured to determine the threshold value depending on the sum of all noise energy in the two or more downmix channels.

According to an embodiment, the downmix signal may encode the one or more audio object signals for each time-frequency tile of a plurality of time-frequency tiles. The threshold determiner 110 may be configured to determine a threshold value for each time-frequency tile of the plurality of time-frequency tiles depending on the signal energy or the noise energy of at least one of the of or more audio object signals or depending on the signal energy or the noise energy of at least one of the one or more downmix channels, wherein a first threshold value of a first time-frequency tile of the plurality of time-frequency tiles may differ from a second time-frequency time of the plurality of time-frequency tiles. The processing unit 120 may be configured to generate for each time-frequency tile of the plurality of time-frequency tiles a channel value of each of the one or more audio output channels from the one or more downmix channels depending on the threshold value if said time-frequency tile.

According to an embodiment, the decoder may be configured to determine the threshold value T according to the formula $$T = \frac{E_{noise}}{E_{ref} \cdot Z} \text{ or according to the formula}$$

$$T = \frac{E_{noise}}{E_{ref}},$$

wherein T indicates the threshold value, wherein $E_{noise}$ indicates the sum of all noise energy in the two or more downmix channels, wherein $E_{ref}$ indicates the signal energy of one of the audio object signals, and wherein Z indicates an additional parameter being a number. In an alternative embodiment, $E_{noise}$ indicates the sum of all noise energy in the two or more downmix channels divided by the number of the downmix channels.

In an embodiment, the decoder may be configured to determine the threshold value T in decibel according to the formula $$T\,[\text{dB}]=E_{noise}\,[\text{dB}]-E_{ref}\,[\text{dB}]-Z \text{ or according to the formula}$$

$$T\,[\text{dB}]=E_{noise}\,[\text{dB}]-E_{ref}\,[\text{dB}],$$

wherein T [dB] indicates the threshold value in decibel, wherein $E_{noise}$ [dB] indicates the sum of all noise energy in the two or more downmix channels in decibel, wherein $E_{ref}$ [dB] indicates the signal energy of one of the audio object signals in decibel, and wherein Z indicates an additional parameter being a number. In an alternative embodiment, $E_{noise}$ [dB] indicates the sum of all noise energy in the two or more downmix channels in decibel divided by the number of the downmix channels.

In particular, a rough estimation of the threshold can be given for each time-frequency tile by:

$$T\,[\text{dB}]=E_{noise}\,[\text{dB}]-E_{ref}\,[\text{dB}]-Z. \quad (5)$$

$E_{noise}$ may indicate the noise floor level, e.g., the sum of all noise energy in the downmix channels. The noise floor can be defined by the resolution of the audio data, e.g., a noise floor caused by PCM-coding of the channels. Another possibility is to account for coding noise if the downmix is compressed. For such a case, the noise floor caused by the coding algorithm can be added. In an alternative embodiment, $E_{noise}$ [dB] indicates the sum of all noise energy in the two or more downmix channels in decibel divided by the number of the downmix channels.

$E_{ref}$ may indicate a reference signal energy. In the simplest form, this can be the energy of the strongest audio object:

$$E_{ref}=\max(E). \quad (6)$$

Z may indicate a penalty factor to cope for additional parameters that affect the separation resolution, e.g. the difference of the number of downmix channels and number of source objects. Separation performance decreases with increasing number of audio objects. Moreover, the effects of the quantization of the parametric side info on the separation can also be included.

In an embodiment, the processing unit 120 is configured to generate the one or more audio output channels from the one or more downmix channels depending on the object covariance matrix E of the one or more audio object signals, depending on the downmix matrix D for downmixing the two or more audio object signals to obtain the two or more downmix channels, and depending on the threshold value.

According to an embodiment, for generating the one or more audio output channels from the one or more downmix channels depending on the threshold value, the processing unit 120 may be configured to proceed as follows:

The threshold (which may be referred to as a "separation-resolution threshold") is applied at the decoder side in the function to inverse the parametrically estimated downmix channel cross correlation matrix Q.

The singular values of Q or the eigenvalues of Q are computed.

The largest eigenvalue is taken and multiplied with the threshold T.

All except the largest eigenvalue are compared to this relative threshold and omitted if they are smaller.

The matrix inversion is then carried out on a modified matrix, wherein the modified matrix may, for example, be the matrix defined by the reduced set of vectors. It should be noted that for the case that all except the highest eigenvalue are omitted, the highest eigenvalue should be set to the noise floor level if the eigenvalue is below.

For example, the processing unit 120 may be configured to generate the one or more audio output channels from the one or more downmix channels by generating the modified matrix. The modified matrix may be generated depending on only those eigenvectors of the downmix channel cross correlation matrix Q, which have an eigenvalue of the eigenvalues of the downmix channel cross correlation matrix Q, which is greater than or equal to the modified threshold. The processing unit 120 may be configured to conduct a matrix inversion of the modified matrix to obtain an inverted matrix. Then, the processing unit 120 may be configured to apply the inverted matrix on one or more of the downmix channels to generate the one or more audio output channels. For example, the inverted matrix may be applied on one or more of the downmix channels in one of the ways as the inverted matrix of the matrix product DED* is applied on the downmix channels (see, e.g. [SAOC], see, in particular, for example: ISO/IEC, "MPEG audio technologies—Part 2: Spatial Audio Object Coding (SAOC)," ISO/IEC JTC1/SC29/WG11 (MPEG) International Standard 23003-2:2010, in particular, see, chapter "SAOC Processing", more particularly, see subchapter "Transcoding modes" and subchapter "Decoding modes").

The parameters which may be employed for estimating the threshold T can be either determined at the encoder and embedded in the parametric side information or estimated directly at the decoder side.

A simplified version of the threshold estimator can be used at the encoder side to indicate potential instabilities in the source estimation at the decoder side. In its simplest form, neglecting all noise terms, the norm of the downmix matrix can be computed indicating that the full potential of the available downmix channels for parametrically estimating the source signals at the decoder side cannot be exploited. Such an indicator can be used during the mixing process to avoid mixing matrices that are critical for estimating the source signals.

Regarding parameterization of the object covariance matrix, one can see that the described parametric upmix method based on the constitutive relationship (4) is invariant to the sign of off-diagonal entities of the object covariance matrix E. This results in possibility of more efficient (in comparison with SAOC) parameterization (quantization and coding) of the values representing inter-object correlations.

Regarding transport of information representing the downmix matrix, generally, the audio input and downmix signals x, y together with the covariance matrix E are determined at the encoder side. The coded representation of the audio downmix signal y and information describing covariance matrix E are transmitted to the decoder side (via bitstream payload). The rendering matrix R is set and available at the decoder side.

The information representing the downmix matrix D (applied at the encoder and used as the decoder) can be determined (at the encoder) and obtained (at the decoder) using the following principle methods.

The downmix matrix D can be:

- set and applied (at the encoder) and its quantized and coded representation explicitly transmitted (to the decoder) via bitstream payload.
- assigned and applied (at the encoder) and restored (at the decoder) using stored lookup tables (i.e. set of predetermined downmix matrices).
- assigned and applied (at the encoder) and restored (at the decoder) according to the specific algorithm or method (e.g. specially weighted and ordered equidistant placement of audio objects to the available downmix channels).
- estimated and applied (at the encoder) and restored (at the decoder) using particular optimization criterion allowing "flexible mixing" of input audio objects (i.e. generation of the downmix matrix that is optimized for the parametric estimation of the audio objects at the decoder side). For example, the encoder generates the downmix matrix in a way to make the parametric upmix more efficient, in terms of special signal property reconstruction, like covariance, inter-signal correlation or improve/ensure numerical stability of the parametric upmix algorithm.

The provided embodiments can be applied on an arbitrary number of downmix/upmix channels. It can be combined with any current and also future audio formats.

The flexibility of the inventive method allows bypassing of unaltered channels to reduce computational complexity, reduce bitstream payload/reduced data amount.

An audio encoder, method or computer program for encoding is provided. Moreover, an audio decoder, method or computer program for decoding is provided. Furthermore, an encoded signal is provided.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[MPS] ISO/IEC 23003-1:2007, MPEG-D (MPEG audio technologies), Part 1: MPEG Surround, 2007.

[BCC] C. Faller and F. Baumgarte, "Binaural Cue Coding—Part II: Schemes and applications," IEEE Trans. on Speech and Audio Proc., vol. 11, no. 6, November 2003

[JSC] C. Faller, "Parametric Joint-Coding of Audio Sources", 120th AES Convention, Paris, 2006

[SAOC1] J. Herre, S. Disch, J. Hilpert, O. Hellmuth: "From SAC To SAOC— Recent Developments in Parametric Coding of Spatial Audio", 22nd Regional UK AES Conference, Cambridge, UK, April 2007

[SAOC2] J. Engdegård, B. Resch, C. Falch, O. Hellmuth, J. Hilpert, A. Hölzer, L.

Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008

[SAOC] ISO/IEC, "MPEG audio technologies—Part 2: Spatial Audio Object Coding (SAOC)," ISO/IEC JTC1/SC29/WG11 (MPEG) International Standard 23003-2.

[ISS1] M. Parvaix and L. Girin: "Informed Source Separation of underdetermined instantaneous Stereo Mixtures using Source Index Embedding", IEEE ICASSP, 2010

[ISS2] M. Parvaix, L. Girin, J.-M. Brossier: "A watermarking-based method for informed source separation of audio signals with a single sensor", IEEE Transactions on Audio, Speech and Language Processing, 2010

[ISS3] A. Liutkus and J. Pinel and R. Badeau and L. Girin and G. Richard: "Informed source separation through spectrogram coding and data embedding", Signal Processing Journal, 2011

[ISS4] A. Ozerov, A. Liutkus, R. Badeau, G. Richard: "Informed source separation: source coding meets source separation", IEEE Workshop on Applications of Signal Processing to Audio and Acoustics, 2011

[ISS5] Shuhua Zhang and Laurent Girin: "An Informed Source Separation System for Speech Signals", INTERSPEECH, 2011

[ISS6] L. Girin and J. Pinel: "Informed Audio Source Separation from Compressed Linear Stereo Mixtures", AES 42nd International Conference: Semantic Audio, 2011

The invention claimed is:

1. A decoder for generating an audio output signal comprising one or more audio output channels from a downmix signal comprising one or more downmix channels, wherein the downmix signal encodes two or more audio object signals, wherein the decoder comprises:

a threshold determiner for determining a threshold value depending on a signal energy or a noise energy of at least one of the two or more audio object signals or depending on a signal energy or a noise energy of at least one of the one or more downmix channels, and a processing unit for generating the one or more audio output channels from the one or more downmix channels depending on the threshold value, wherein the processing unit is configured to generate the one or more audio output channels from the one or more downmix channels depending on an object covariance matrix of the one or more audio object signals, depending on a downmix matrix for downmixing the two or more audio object signals to obtain the one or more downmix channels, and depending on the threshold value, wherein the processing unit is configured to generate the one or more audio output channels from the one or more downmix channels by applying the threshold value in a function to inverse a downmix channel cross correlation matrix Q, wherein Q is defined as Q=DED*, wherein D is the downmix matrix for downmixing the two or more audio object signals to obtain the two or more downmix channels, wherein E is the object covariance matrix of the one or more audio object signals, and wherein the processing unit is configured to generate the one or more audio output channels from the one or more downmix channels by computing eigenvalues of the downmix channel cross correlation matrix Q;

wherein each eigenvalue except largest eigenvalue is compared to the threshold value, and omitted if they are smaller.

2. The decoder according to claim 1, wherein the downmix signal comprises two or more downmix channels, and wherein the threshold determiner is configured to determine the threshold value depending on a noise energy of each of the two or more downmix channels.

3. The decoder according to claim 2, wherein the threshold determiner is configured to determine the threshold value depending on a sum of all noise energy in the two or more downmix channels.

4. The decoder according to claim 1, wherein the processing unit is configured to generate the one or more audio output channels from the one or more downmix channels by multiplying a largest eigenvalue of the eigenvalues of the downmix channel cross correlation matrix Q with the threshold value to acquire a relative threshold.

5. The decoder according to claim 4, wherein the processing unit is configured to generate the one or more audio output channels from the one or more downmix channels by generating a modified matrix, wherein the processing unit is configured to generate the modified matrix depending on only those eigenvectors of the downmix channel cross correlation matrix Q, which comprise an eigenvalue of the eigenvalues of the downmix channel cross correlation matrix Q, which is greater than or equal to the relative threshold, wherein the processing unit is configured to conduct a matrix inversion of the modified matrix to acquire an inverted matrix, and wherein the processing unit is configured to apply the inverted matrix on one or more of the downmix channels to generate the one or more audio output channels.

6. The decoder according to claim 1, wherein the threshold determiner is configured to determine the threshold value depending on a signal energy of the audio object signal of the two or more audio object signals which comprises the greatest signal energy of the two or more audio object signals.

7. The decoder according to claim 1, wherein the downmix signal encodes the two or more audio object signals for each time-frequency tile of a plurality of time-frequency tiles, wherein the threshold determiner is configured to determine a threshold value for each time-frequency tile of the plurality of time-frequency tiles depending on the signal energy or the noise energy of at least one of the two or more audio object signals or depending on the signal energy or the noise energy of at least one of the one or more downmix channels, and wherein the processing unit is configured to generate for each time-frequency tile of the plurality of time-frequency tiles a channel value of each of the one or more audio output channels from the one or more downmix channels depending on the threshold value of said time-frequency tile.

8. The decoder according to claim 1, wherein the downmix signal comprises two or more downmix channels, wherein the decoder is configured to determine the threshold value T in decibel according to the formula $T\,[\mathrm{dB}]=E_{noise}\,[\mathrm{dB}]-E_{ref}\,[\mathrm{dB}]-Z$ or according to the formula $T\,[\mathrm{dB}]=E_{noise}\,[\mathrm{dB}]-E_{ref}\,[\mathrm{dB}]$, wherein T [dB] indicates the threshold value in decibel, wherein $E_{noise}$ [dB] indicates a sum of all noise energy in the two or more downmix channels in decibel, or $E_{noise}$

[dB] indicates the sum of all noise energy in the two or more downmix channels in decibel divided by the number of the two or more downmix channels, wherein $E_{ref}$ [dB] indicates the signal energy of one of the audio object signals in decibel, and wherein Z indicates an additional parameter being a number.

9. The decoder according to claim 1, wherein the downmix signal comprises two or more downmix channels, wherein the decoder is configured to determine the threshold value T according to the formula $$T = \frac{E_{noise}}{E_{ref} \cdot Z} \text{ or according to the formula}$$

$$T = \frac{E_{noise}}{E_{ref}},$$

wherein T indicates the threshold value, wherein $E_{noise}$ indicates a sum of all noise energy in the two or more downmix channels, or $E_{noise}$ in decibel indicates a sum of all noise energy in the two or more downmix channels in decibel divided by the number of the two or more downmix channels, wherein $E_{ref}$ indicates the signal energy of one of the audio object signals, and wherein Z indicates an additional parameter being a number.

10. A method for generating an audio output signal comprising one or more audio output channels from a downmix signal comprising one or more downmix channels, wherein the downmix signal encodes two or more audio object signals, wherein the method comprises:

determining a threshold value depending on a signal energy or a noise energy of at least one of the two or more audio object signals or depending on a signal energy or a noise energy of at least one of the one or more downmix channels, and generating the one or more audio output channels from the one or more downmix channels depending on the threshold value, wherein generating the one or more audio output channels from the one or more downmix channels depending on an object covariance matrix (E) of the one or more audio object signals is conducted depending on a downmix matrix (D) for downmixing the two or more audio object signals to obtain the one or more downmix channels, and depending on the threshold value, wherein generating the one or more audio output channels from the one or more downmix channels is conducted by applying the threshold value in a function to inverse a downmix channel cross correlation matrix Q, wherein Q is defined as Q=DED*, wherein D is the downmix matrix for downmixing the two or more audio object signals to obtain the two or more downmix channels, wherein E is the object covariance matrix of the one or more audio object signals, and wherein generating the one or more audio output channels from the one or more downmix channels is conducted by computing eigenvalues of the downmix channel cross correlation matrix Q;

wherein each eigenvalue except largest eigenvalue is compared to the threshold value, and omitted if they are smaller.

11. A non-transitory digital storage medium comprising a computer program for implementing the method of claim 10 when being executed on a computer or signal processor.

* * * * *